US007280103B2

(12) United States Patent
Taoka et al.

(10) Patent No.: US 7,280,103 B2
(45) Date of Patent: Oct. 9, 2007

(54) DISPLAY METHOD, DISPLAY APPARATUS AND DATA WRITE CIRCUIT UTILIZED THEREFOR

(75) Inventors: Mineki Taoka, Higashiosaka (JP); Yukio Mori, Hirakata (JP); Takashi Ikeda, Higashiosaka (JP)

(73) Assignee: Sanyo Electric Co., Ltd., Osaka (JP)

( * ) Notice: Subject to any disclaimer, the term of this patent is extended or adjusted under 35 U.S.C. 154(b) by 635 days.

(21) Appl. No.: 10/772,279

(22) Filed: Feb. 6, 2004

(65) Prior Publication Data

US 2004/0155847 A1 Aug. 12, 2004

(30) Foreign Application Priority Data

Feb. 7, 2003 (JP) ..... 2003-031374

(51) Int. Cl.
*G09G 3/36* (2006.01)

(52) U.S. Cl. ..... 345/204; 345/87; 345/90; 345/98; 345/99; 345/205; 345/213

(58) Field of Classification Search ..... 345/87, 345/89, 90, 98, 99, 204, 213, 690, 205, 215
See application file for complete search history.

(56) References Cited

U.S. PATENT DOCUMENTS 6,040,812 A * 3/2000 Lewis ..... 345/89
6,115,016 A * 9/2000 Yoshihara et al. ..... 345/88
6,452,589 B1 * 9/2002 McKnight ..... 345/205
6,545,656 B1 * 4/2003 Yamazaki ..... 345/94
2001/0052886 A1 * 12/2001 Ikeda ..... 345/87
2002/0000960 A1 * 1/2002 Yoshihara et al. ..... 345/87
2003/0011739 A1 * 1/2003 Yoshihara et al. ..... 349/172

FOREIGN PATENT DOCUMENTS

JP P2001-125066 5/2001
JP 2001-296841 A 10/2001
JP P2002-40390 2/2002
JP 2003-22061 A 1/2003

OTHER PUBLICATIONS

Japanese Office Action, with English translation, issued in Japanese Patent Application No. JP 2003-031374, mailed Apr. 23, 2007.

* cited by examiner

*Primary Examiner*—Bipin Shalwala
*Assistant Examiner*—Vincent E. Kovalick
(74) *Attorney, Agent, or Firm*—McDermott Will & Emery LLP

(57) ABSTRACT

A hold-type display apparatus is more likely to suffer the deterioration in the visibility of moving images due to the blur effect, compared to an impulse-type display apparatus. A single frame period is divided into a first period and a second period. Pixel data to be written to a pixel are written in a concentrated manner in the first period during a frame period. At this time, a write value for the pixel is set to twice a value of the image data in order not to lower the brightness of the images as a whole. However, only if the doubled value exceeds a range that can be displayed, the remaining pixel data are written in the second period. Thus, the change in display brightness approximates the impulse-type display apparatus, so that the visibility of moving images is improved.

14 Claims, 13 Drawing Sheets

FIG.3

| Dout / Din | FIRST PERIOD | SECOND PERIOD |
|---|---|---|
| 0～127 | 0～254<br>2Din | 0 |
| 128～255 | 254 | 0～254<br>2Din－254 |

FIG.4

| Dout / Din | FIRST PERIOD | SECOND PERIOD |
|---|---|---|
| 0～199 | 0～398<br>2Din | 0 |
| 200～255 | 398 | 0～112<br>2Din－398 |

DISPLAY METHOD, DISPLAY APPARATUS AND DATA WRITE CIRCUIT UTILIZED THEREFOR

BACKGROUND OF THE INVENTION

1. Field of the Invention

The present invention relates to the display technologies, and it particularly relates to a method for displaying the moving pictures on a hold-type display apparatus, a display apparatus utilizing said method and a data write circuit usable for said display apparatus.

2. Description of the Related Art

Liquid crystal displays (hereinafter referred to as "LCDs") and plasma displays (hereinafter referred to as "PDPs") are increasingly becoming high-performance in recent years. These displays, helped by their intrinsically thin structure, are now about to wrest the leading role for TV receivers from cathode-ray tubes (hereinafter referred to as "CRTs"). This trend may keep accelerating in the years ahead.

However, it is now known that LCDs and PDPs (hereinafter referred to as "LCDs and the like") are subject to some degradation of moving picture quality due to a difference in display principle from CRTs. That is, LCDs and the like are so-called "hold-type" displays for which transistors are used as selector switches for each pixel and a displayed image is held for one frame period. On the other hand, CRTs are so-called "impulse-type" displays in which selected pixels brighten up for their respectively selected periods and go out immediately afterward.

When a user observes a moving object on the screen of a display, his/her eyes follow the moving object smoothly even when the image is rewritten discretely at a frequency of 60 Hz for instance. With an impulse-type display, the pixels dim in the interval between the frames of a moving picture, and the image of the moving object in a next frame appears timely in a position where the eyes, as they move, expect it to appear. Hence, there is no hindrance to the smooth motion of the eyes.

In the observation of the same moving object on a hold-type display, on the other hand, an image of a previous frame is displayed until immediately before an image of the next frame is displayed. As a result, for the eyes that follow the moving object in a smooth motion, there results a disparity between the position of the displayed moving object and the position sensed by the eyes as the center of the moving object, so that the moving object is recognized as a blurred image. Hereinbelow, this problem will be referred to as the blur effect of a hold-type display, or simply as the blur effect.

Reference (1) in the following Related Art List discloses a solution by which the blur effect is reduced by adjusting the on and off timings of the light sources. Reference (2) in the Related Art List discloses a solution in which the ratio of on and off periods of the light sources is adjusted.

Related Art List (1) Japanese Patent Application Laid-Open No. 2001-125066.

(2) Japanese Patent Application Laid-Open No. 2002-40390.

SUMMARY OF THE INVENTION

The present invention has been made to eliminate the above-mentioned blur effect and an object thereof is to provide a hold-type display with improved moving picture quality or improved visibility of moving images. Another object thereof is to provide a technology that is applicable also to the type of displays, such as PDP, which are self-luminous without light sources.

A preferred embodiment according to the present invention relates to a display method. This method is characterized in that effective writing is conducted in a concentrated manner in a partial period during a frame period when a desired pixel value is written to a pixel in a hold-type display apparatus and, in so conducting, a write value in the partial period is set higher than the desired pixel value so that the desired pixel value is realized, in terms of visibility, by the writing in the partial period "The desired pixel value is realized in terms of visibility" means, for example, that desired brightness is realized. According to this method, write values to be written to pixels are relatively low except for the partial period, with the result that the satisfactory visibility of moving images similar to that realized in the impulse-type display apparatus can be obtained.

Another preferred embodiment according to the present invention relates also to a display method. This method is characterized in that effective writing is conducted in a concentrated manner in a partial period during a frame period when a desired pixel value is written to a pixel in a hold-type display apparatus and, in so conducting, a predetermined relationship is given between an integral value of a write value written in the partial period and an integral value of the desired pixel value in the frame period. It is to be noted here that a "frame" constitutes the unit for a display of images and it will be used as a representative concept including a field.

Examples for the predetermined relationship include a case that the both values are equal, a case that one is proportional to the other and vice versa, a case that one is a function of the other and so forth. If the both values are equal, the display brightness for both the commonly used conventional display method and the method according to the present embodiment is equal to each other. According to the present method, the write values to be written to the pixels become small except for the partial period, so that the visibility of moving images is improved. If the former is larger, brighter images will of course be obtained. If, on the other hand, the latter is larger, the visibility of moving images will be further improved.

Still another preferred embodiment according to the present invention relates to a data write circuit for driving a hold-type display apparatus. This data write circuit includes means for performing effective writing in a concentrated manner in a partial period during a frame period when a desired pixel value is written to a pixel and which has means for setting a write value in the partial period higher than the desired pixel value so that the desired pixel value is realized, in terms of visibility, by the writing in the partial period.

Still another preferred embodiment according to the present invention relates also to a data write circuit for driving a hold-type display apparatus. This data write circuit includes means for performing effective writing in a concentrated manner in a partial period during a frame period when a desired pixel value is written to a pixel and which has means for writing data in a manner such that a predetermined relationship is given between an integral value of a write value written in the partial period and an integral value of the desired pixel value in the frame period.

Still another preferred embodiment according to the present invention relates also to a data write circuit for driving a hold-type display apparatus. This data write circuit includes means for writing in a first period n times a desired pixel value to be written to a pixel and writing 0 (zero) in a second period and thereafter where a frame period is divided into n parts and each divided period is denoted by first to nth period (n being an integer greater than or equal to 2). However, when a pixel value that is n times the desired pixel value exceeds a displayable range of the display apparatus, the writing means writes to the pixel an upper limit value of the range in the first period, and an excess part that remains unwritten is written to the pixel upon arrival of the second period and, thereafter, an excess part that cannot be written out in an ith period ($2 \leqq i \leqq n-1$) is written sequentially upon arrival of an (i+1)th period. In this manner, the effective writing can be completed at as early timing as possible, so that the visibility of moving images can be improved.

As another example of this data write circuit, there may be provided a data write circuit which includes means for writing in an ith period ($2 \leqq i < n$) n times a desired pixel value to be written to a pixel and writing 0 (zero) in periods other than the ith period. When a pixel value that is n times the desired pixel value exceeds a displayable range of the display apparatus, the writing means may write, in the ith period, an upper limit value of the range to the pixel and distribute an excess part that cannot be written out in a symmetrical manner with the ith period at a center, so that pixel values thus distributed before and after the ith period are written to the pixel. The ith period may be a midpoint period in the frame period for which $n=2i-1$.

In such a case, the writing of the pixel value can be concentrated in a partial period during a frame period, so that the visibility of moving images can be improved. For example, when the color of a pixel consists in a plurality thereof such as RGB, the ith period serves as the temporal center at the time of writing a pixel value in any of colors Thus, the maximum timings of brightness are synchronized among pixels of different colors and, as a result thereof, the deterioration of the visibility due to the so-called color distortion can be easily prevented.

The above data write circuit may further include means for calculating a pixel value to be written to the pixel, at the time the pixel value is written in the first to nth periods, in a manner such that the pixel value is calculated after the frame is reconstructed by incorporating a motion compensation that corresponds to time shifts for those periods. Between the first period and the second period there is a time difference that corresponds to 1/n of a frame period. Thus, the frame may be advanced, for the time duration corresponding to the time difference, through motion compensation or other frame reconstructing methods, so that the pixel value in the second period can be determined based on the new frame In that case, realized is a smooth display of moving image where the motion compensation is also taken into consideration. However, the data write circuit may further include means for judging whether this frame should not be used if the reconstructed frame has low reliability.

Still another preferred embodiment according to the present invention relates to a hold-type display apparatus. This display apparatus includes: a pixel array; any one of the above-described data write circuits which writes data to the pixel array in a row direction; and a scanning line drive circuit which scans the pixel array in a column direction.

It is to be noted that any arbitrary combination of the above-described structural components and processing steps and the expressions changed between a method, an apparatus, a system and so forth are all effective as and encompassed by the present embodiments.

Moreover, this summary of the invention does not necessarily describe all necessary features so that the invention may also be sub-combination of these described features.

BRIEF DESCRIPTION OF THE DRAWINGS

FIG. 3 is a diagram for explaining an operation of an output value determining unit shown in FIG. 2.

FIG. 4 is a diagram for explaining another operation of the output value determining unit shown in FIG. 2.

DETAILED DESCRIPTION OF THE INVENTION

The invention will now be described based on the following embodiments which do not intend to limit the scope of the present invention but exemplify the invention. All of the features and the combinations thereof described in the embodiments are not necessarily essential to the invention.

Figure 1:
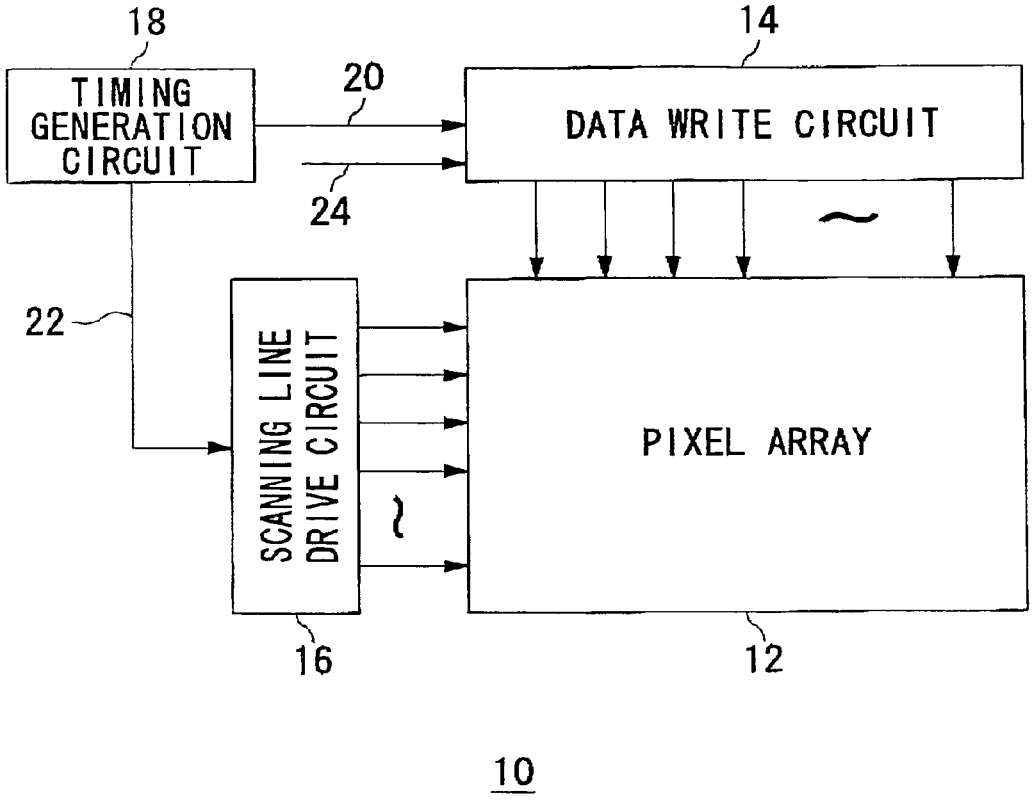
FIG. 1 shows a structure of a display apparatus according to an embodiment of the present invention.

FIG. 1 shows a structure of a display apparatus 10 according to an embodiment of the present invention. The display apparatus 10 includes a pixel array 12 comprised of liquid crystals arranged in a matrix, a data write circuit 14 for writing pixel values, or pixel data, to the pixels in each row of the pixel array 12, a scanning line drive circuit 16 for scanning the pixel array 12 in the column direction, and a timing generation circuit 18 for setting timings for the write operation by the data write circuit 14 and the scanning line drive circuit 16.

The timing generation circuit 18, which has a built-in PLL (Phase Lock Loop) circuit, generates for the data write circuit 14 the number of pulses equal to the number of pixels in the horizontal direction from a horizontal synchronizing signal, doubles the speed thereof and outputs the signal as a write clock 20. The timing generation circuit 18 also outputs a scan clock 22, which is of twice the normal speed, to the scanning line drive circuit 16. Image data 24 are inputted to the data write circuit 14 from an external circuit (not shown).

In this configuration, the image data 24 are outputted from the data write circuit 14 as data to be written in the pixels in each line of the pixel array 12. On the other hand, the scanning line drive circuit 16 selects lines in which the data are to be written actually. As a result, the pixel data outputted from the data write circuit 14 are written into the respective pixels in the lines selected by the scanning line drive circuit 16.

Pixel data are normally written once for all the pixels of the pixel array 12 during one frame period. A feature of the present embodiment, however, lies in the write clock 20 and the scan clock 22 given as signals of a frequency twice the normal speed. Consequently, the data write period for each pixel in the pixel array 12 occurs twice during a normal frame period. During the first of the two periods (hereinafter referred to as "the first period"), an effective writing of pixel data, namely, a writing of a component equivalent to the major part of the pixel data, is completed, so that in the second of the two periods (hereinafter referred to as "the second period"), pixel data as close to 0 (zero), or black, as possible can be written. Thereby, during the latter half of one frame period, that is, during the second period, the pixels in the pixel array 12 turn into colors closer to black, thus suppressing and minimizing the blur effect.

However, if the pixel array 12 is to be illuminated within the first period only, then the brightness as a whole will naturally drop. In the present embodiment, therefore, twice the values of normal pixel data to be written in the respective pixels are written in the first period, and as a rule, "0" is written as pixel data in the second period. Nevertheless, when the double pixel data to be written in the first period exceed the upper limit of the dynamic range that can be displayed by the display apparatus 10 (hereinafter referred to simply as "range"), the excess part is written in the second period. This arrangement realizes a desired integral value for the pixel data for the whole one-frame period including the first and second periods, and thus the brightness of the screen as a whole can be maintained.

Figure 2:
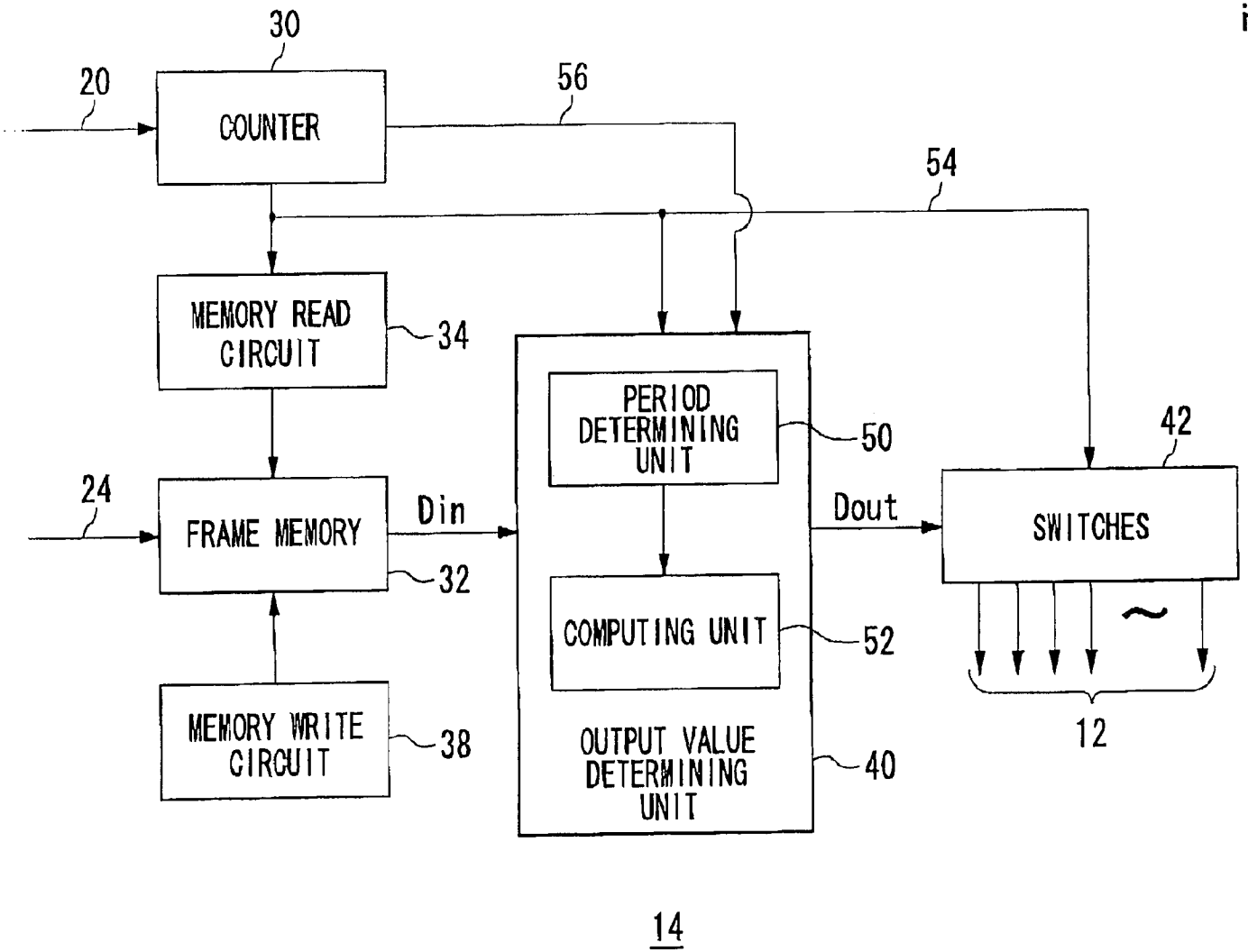
FIG. 2 shows a structure of a data write circuit in the display apparatus shown in FIG. 1.

FIG. 2 shows an internal structure of a data write circuit 14. The data write circuit 14 includes a counter 30 for counting write clocks 20, a frame memory 32 for storing image data 24, a memory read circuit 34 for controlling the readout of data from the frame memory 32, a memory write circuit 38 for controlling the writing of data to the same frame memory 32, an output value determining unit 40 for receiving image data Din outputted from the frame memory 32 and outputting appropriate pixel data Dout for the first and the second period, respectively, and switches 42 for outputting the pixel data Dout outputted from the output value determining unit 40 to the corresponding pixels.

Suppose that the number of pixels in the horizontal direction of the pixel array 12 is x. The counter 30 repeats counting from 0 to x−1 and outputs a current numeral as a count value 54. The count value 54 is inputted to the memory read circuit 34, the output value determining unit 40 and the switches 42. The counter 30 also outputs a carry bit 56, which turns back whenever the count value 54 becomes x−1, to the output value determining unit 40.

The memory read circuit 34 reads pixel data Din out of the frame memory 32 according to the count value 54. The pixel data Din are read out sequentially in the horizontal direction, that is, row by row, of the pixel array 12. On the other hand, the memory write circuit 38 writes image data 24 sequentially in the frame memory 32 according to timing signals, which are not shown here.

Since the counter 30 uses a write clock 20 which is of twice the normal speed, the readout from the frame memory 32 by the memory read circuit 34 is also conducted at a double speed. Hence, image data for the pixels numbered 0 to x−1 in each row are read out once in each of the first period and the second period.

The output value determining unit 40 includes a period determining unit 50 and a computing unit 52. The period determining unit 50 determines, based on the carry bit 56, whether the current period is the first or the second period. Supposing the initial value of the carry bit is 0, the current period will be determined to be the first period when the carry bit is 0. And it will be determined to be the second period when it is 1.

Now, the pixel data inputted from the frame memory 32 to the output value determining unit 40 are denoted by "Din", whereas the pixel data outputted from the output value determining unit 40 are denoted by "Dout". The range of the pixel array 12 is denoted by R. The computing unit 52 performs computations as described below.

(1) In the first period:

When R>2Din, Dout=2Din when R≦2Din, Dout=R (2) In the second period:

When R>2Din, Dout=0

When R≦2Din, Dout=2Din−R

Through the above operation, pixel data Dout outputted from the output value determining unit 40 are written in the respective pixels by way of the switches 42. Pixel data Dout in the first period and pixel data Dout in the second period are written in the respective pixels in the respective periods.

FIG. 3 is a diagram for explaining the operation of the output value determining unit 40. Shown here is the relationship between input pixel data Din and output pixel data Dout when range R is 255. As shown in the diagram, when the input pixel data Din are 0 to 127, the output value determining unit 40 outputs 2Din values, which are 0 to 254, in the first period. It will output "0" in the second period, however.

When the input pixel data Din are 128 to 255, the output value determining unit 40 outputs 254 in the first period. And in the second period, it outputs the values of 2Din−254, which are 0 to 254.

FIG. 4 is a diagram for explaining another operation of the output value determining unit 40. Here, the range R is 399, which corresponds to a case where the display apparatus 10 has a high display performance. In this case, too, the maximum value of input pixel data Din is 255. Namely, it is supposed here that the pixel data are represented in 8 bits. As shown in the diagram, then the input pixel data Din are 0 to 199, the output value determining unit 40 outputs 2Din values, which are 0 to 398, in the first period. And it outputs "0" in the second period. On the other hand, when the input pixel data Din are 200 to 255, the output value determining unit 40 outputs 398 in the first period. And in the second period, it outputs the values of 2Din−398, which are 0 to 112.

Figure 5A:
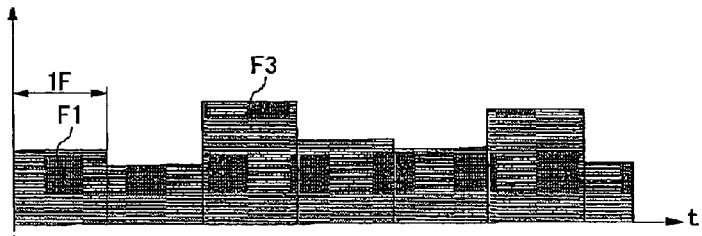
FIGS. 5A to 5C represent a case where range R is 255 as in FIG. 3, and show changes in their display brightness with time.
Figure 5B:
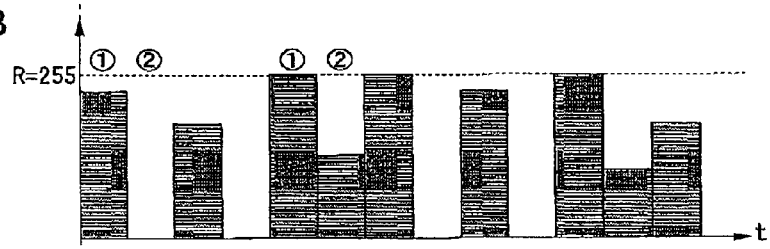
Figure 5C:
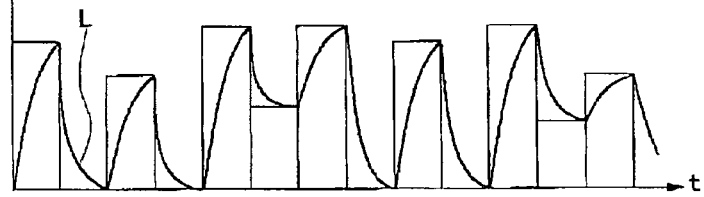

FIGS. 5A to 5C show changes in display brightness with time of the display apparatus 10 according to the present embodiment. FIGS. 5A to 5C represent a case where range R is 255 as in FIG. 3. FIG. 5A shows the display brightness of a commonly used conventional hold-type display apparatus, with "1F" in it corresponding to one frame period. That is, as shown in FIG. 5A, pixel data are written in each frame and the data are held for one frame period. On the other hand, FIG. 5B shows the display brightness of a display apparatus 10 according to the present embodiment.

In FIG. 5B, (1) and (2) represent the first period and the second period, respectively. In frame F1 of FIG. 5A, R>2Din holds, so that in FIG. 5B, pixel data are written only during the first period (1) and "0" is written in the second period (2). In frame F3 of FIG. 5A, R<2Din holds, so that as shown in FIG. 5B, the maximum value that can be written is written during the first period (1), and the remaining pixel data are written during the second period (2). For both FIGS. 5A and 5B, the integrated value of pixel data for each one frame period is the same in any of the frames and the display brightness is thus maintained.

FIG. 5C schematically shows the behavior of actual display brightness that results from the pixel data written as in FIG. 5B in the present embodiment. The solid line L on FIG. 5C shows the changes in display brightness. The behavior of display brightness approximates that of an impulse-type display apparatus, with the result that an improvement in the visibility of moving images can be achieved for the hold-type display apparatus.

Figure 6A:
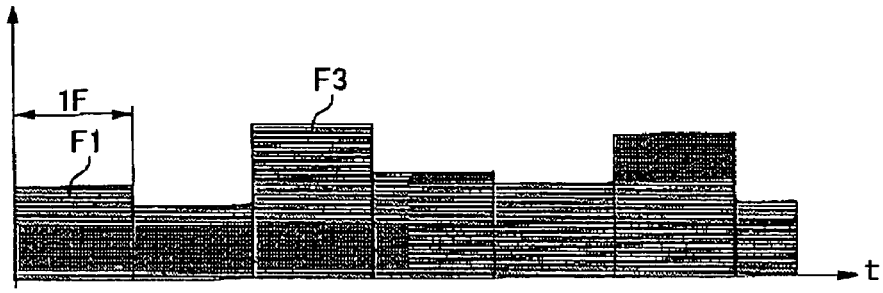
FIGS. 6A and 6B show changes in display brightness with time in a case where range R is 399 as shown in FIG. 4.
Figure 6B:
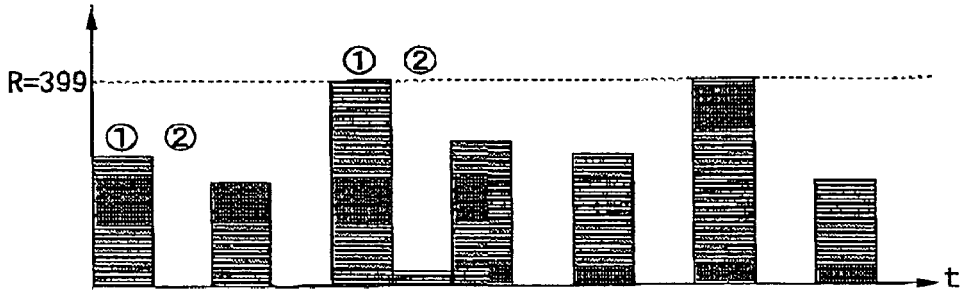

FIGS. 6A and 6B show changes in display brightness with time in the same manner as FIGS. 5A and 5B, assuming, however, a case where range R is 399 as shown in FIG. 4. FIG. 6A is the same as FIG. 5A. FIG. 6B, on the other hand, differs from FIG. 5B due to the difference in range. Now, paying attention to frame F3, it may be understood that in FIG. 6B, pixel data that can be written in the first period are as large as 398, so that the remaining brightness data to be written in the second period become small as compared with the frame F3 in FIG. 5B. Accordingly, the larger the range R of a display apparatus 10 is, the more marked the improvement in visibility of moving images according to the present embodiment will be.

By thus implementing the present embodiment, the display characteristics of a hold-type display apparatus can be brought to closer to those of an impulse-type display apparatus, thus reducing the blur effect.

Figure 7A:
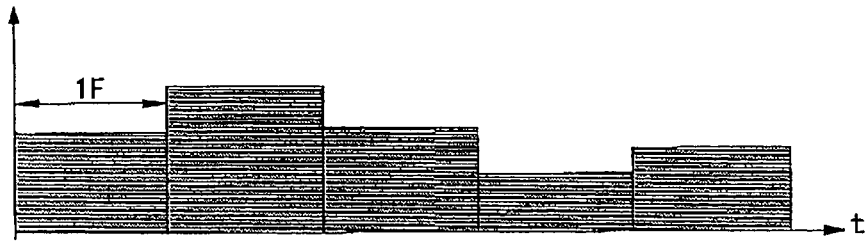
FIGS. 7A to 7C show examples of variation in dividing one-frame period and FIG. 7C shows a case where one frame period is divided in four.
Figure 7B:
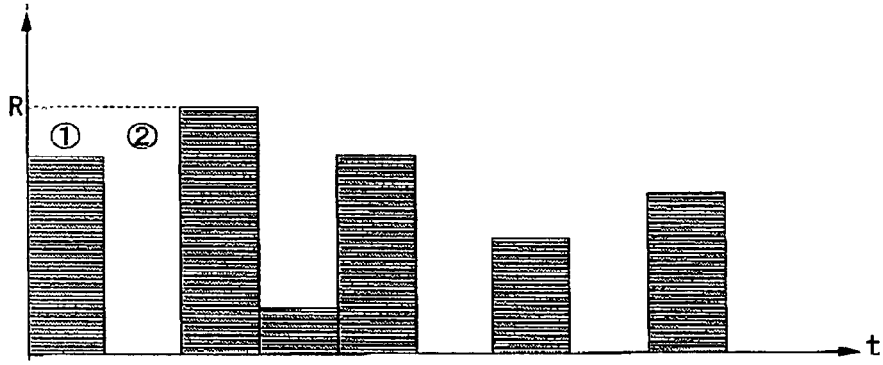
Figure 7C:
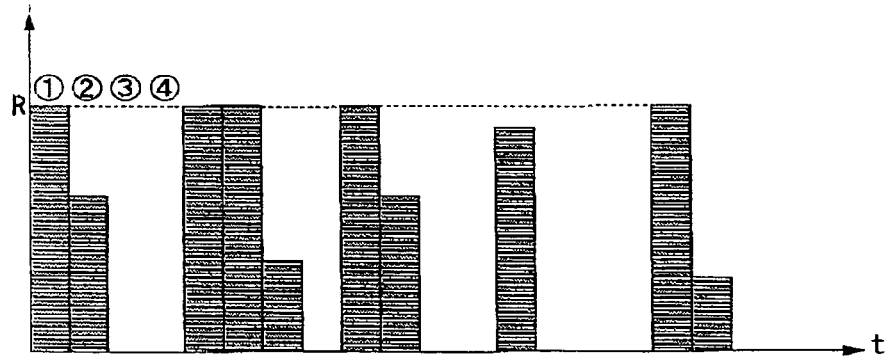

In the present embodiment, a one-frame period is divided into two periods, namely, the first period and the second period. However, the number of divisions may be arbitrary. FIG. 7C show an example of such variation. FIG. 7A shows changes in display brightness with time of a commonly used conventional hold-type display apparatus. FIG. 7B corresponds to the above-described case of the present embodiment where one frame period is divided in two and writing is conducted in both the first and the second period. On the other hand, FIG. 7C shows a case where one frame period is divided in four and writing is conducted in the first period (1), the second period (2), the third period (3) and the fourth period (4).

Where one frame period is divided into four parts as in FIG. 7C, the write clock 20 shown in FIG. 2 operates at four times the normal speed. As a result, pixel data for the respective pixels are read out from the frame memory 32 four times within a one-frame period. The carry bit 56 undergoes a status change of 0, 1, 0, 1 during one frame period, from which the period determining unit 50 in the output value determining unit 40 can determine the first to the fourth period. However, with two bits provided for the carry bit 56, the status may change as 00, 01, 10, 11 and the period may be determined from these two bits.

In the first period, the computing unit 52 in the output value determining unit 40 carries out the following processing:

When R>4Din, Dout=4Din, and Din←0

When R≦4Din, Dout=R, and Din←Din←R/4

Thus pixel data Dout are outputted, and Din for the next period is updated. Similarly, for the second to the fourth period, the following processing is repeated:

When R>4Din, Dout=4Din, and Din←0

When R≦4Din, Dout=R, and Din←Din←R/4

In the case where one frame period is divided into four parts as described above, the majority of the components of pixel data may be concentrated in the first half of one frame period, so that the visibility of the moving images can be further improved.

Figure 8:
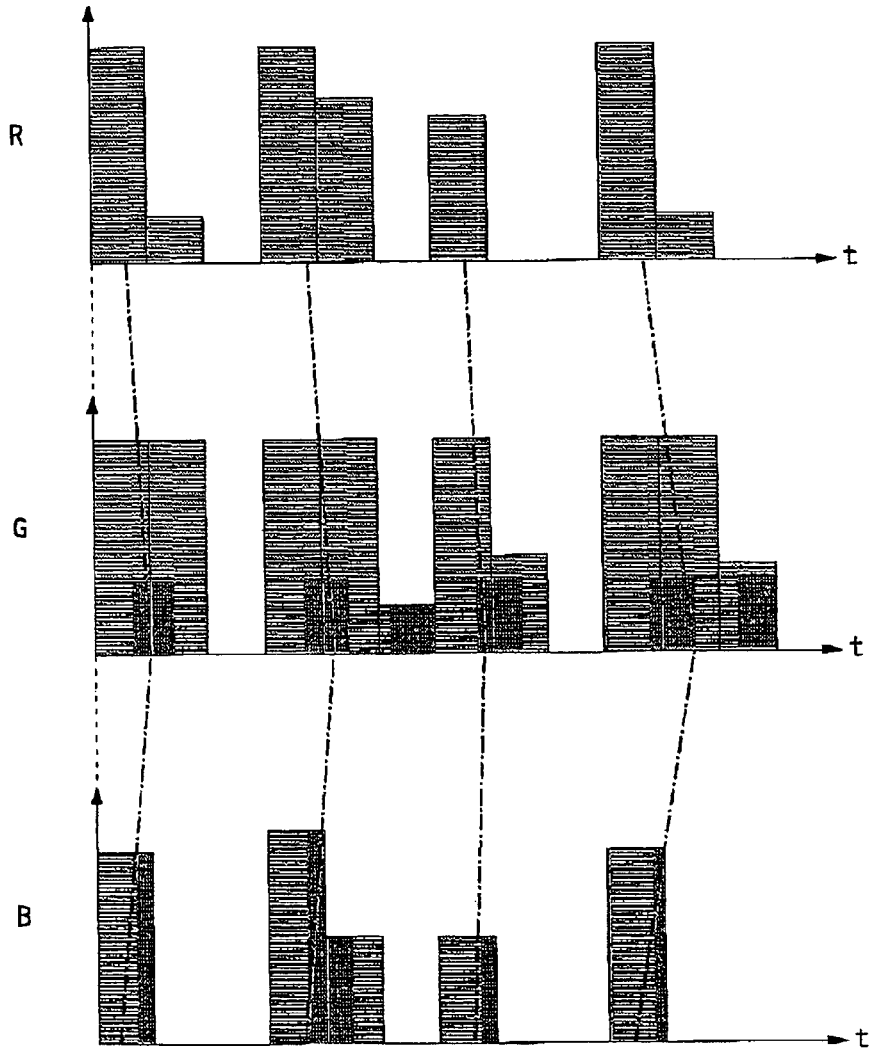
FIG. 8 conceptually shows a problem possibly encountered in a color display in the present embodiment.

In the above examples, the effective writing of pixel data is conducted at preferably earlier timings in a frame period. In color display, however, other considerations are desired. FIG. 8 schematically shows a three-color display of RGB. Here, writing is driven at three times the normal speed, and the color components of pixel data are written as much in the first period of the first to third periods as possible. In conducting so, however, in the color images derived by merging the three colors of RGB, there occur dislocations of the centroids of display time for the three colors by pixels in the motion areas as delineated by the chain lines in FIG. 8. As a result of thereof, each of the colors has its own motion blur, thus causing color distortion in the moving objects.

Figure 9A:
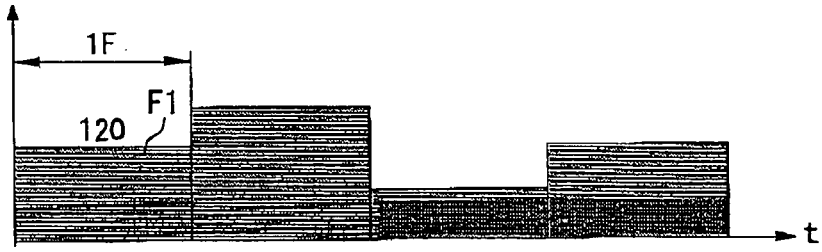
FIGS. 9A to 9C conceptually show processings to solve the problem, possibly encountered in the color display, by a data write circuit according to the present embodiment.
Figure 9B:
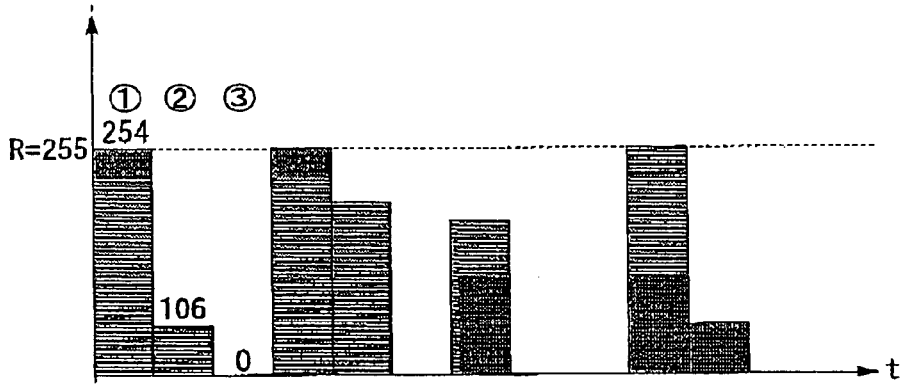
Figure 9C:
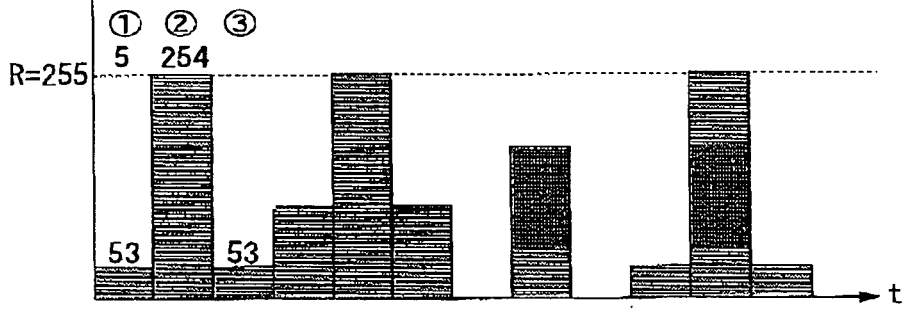
Figure 10:
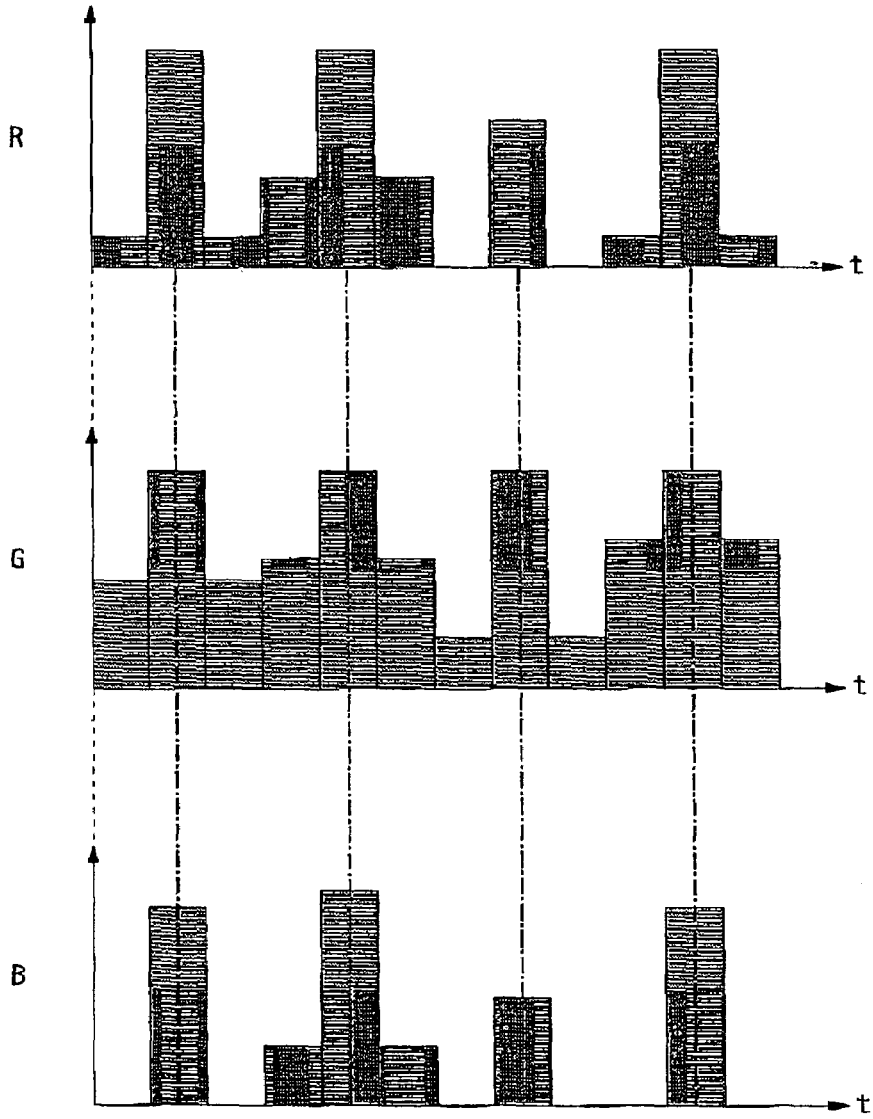
FIG. 10 explains why the problem possibly encountered in the color display is solved by the processing shown in FIGS. 9B and 9C.

For color images, therefore, this phenomenon of color distortion is eliminated with the computing unit 52 distributing the pixel data symmetrically in the time direction as shown in FIG. 9C. FIGS. 9A, 9B and 9C show a case that original data are written as they are, a case that the writing of the pixel data is concentrated in the first period, and a case that the pixel data are written symmetrically with the second period at the center, respectively. Here, it is assumed that "120" pixel data are written in frame F1 on a three-speed drive. In FIG. 9B, "254" pixel data are written in the first period (1) and "106" are written in the second period (2), that is, a total of 120×3=360 are written. In FIG. 9C, on the other hand, the computing unit 52 for color application performs processings for writing "254", in the second period (2) and a half of the remaining "106", namely, "53" in each of the first period (1) and the third period (3). FIG. 10 shows the cases of display where the pixel data written in the manner of FIG. 9C are again divided into the respective components of RGB. In this case, as delineated by the chain lines, satisfactory moving images in color are obtained without color distortions with time.

Figure 11:
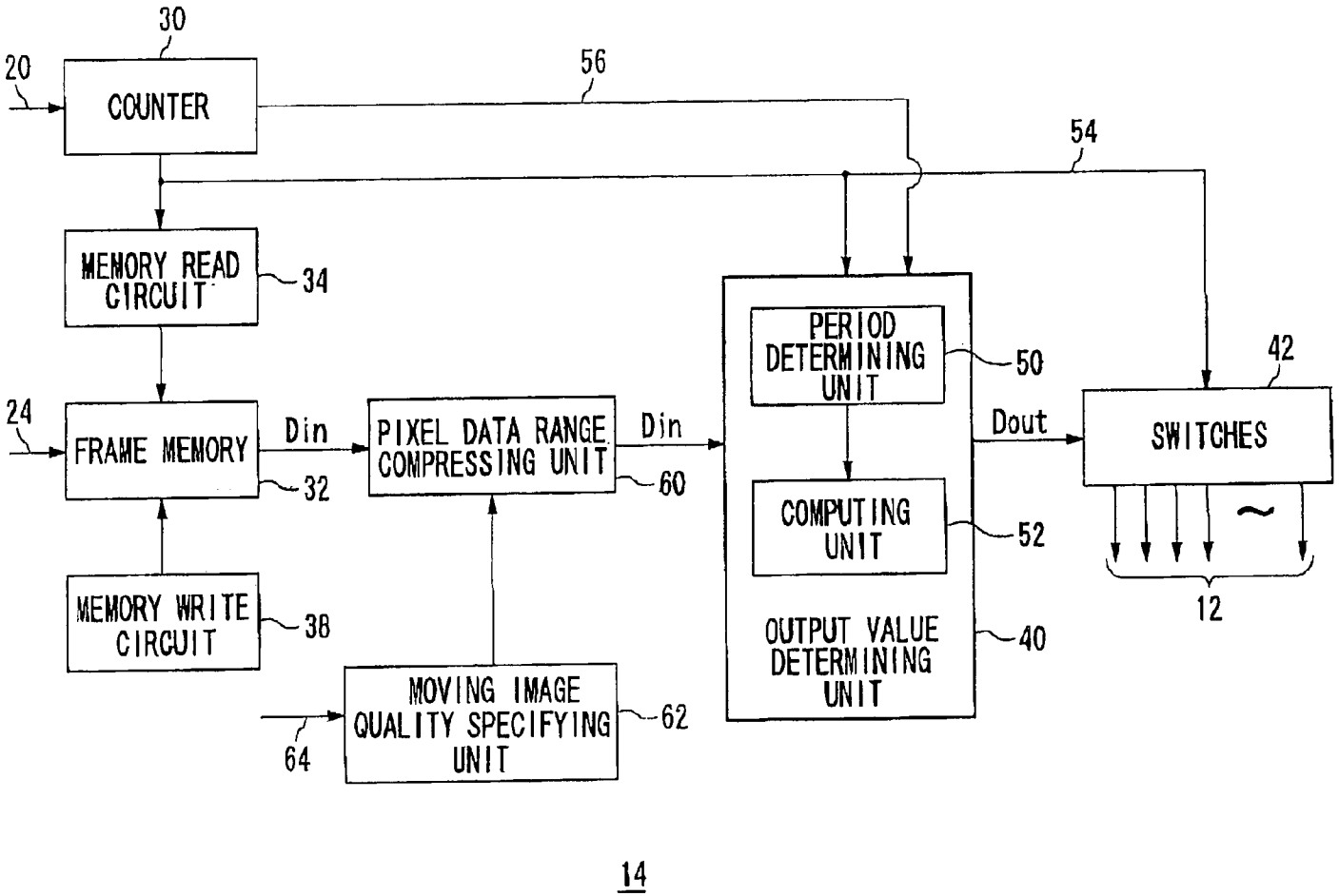
FIG. 11 shows a structure of a data write circuit according to another embodiment of the present invention.

FIG. 11 shows a structure of a data write circuit 14 according to another embodiment of the present invention. In FIG. 11, the components thereof identical to those in FIG. 2 will be designated by the same reference numerals, and the description thereof is omitted as appropriate. New structures in FIG. 11 are a pixel data range compressing unit 60 provided between the frame memory 32 and the output value determining unit 40, and a moving image quality specifying unit 62 which receives user requests 64 and outputs instructions to the pixel data range compressing unit 60 accordingly. The pixel data range compressing unit 60 compresses the range of input pixel data Din. The moving image quality specifying unit 62 conveys an image quality desired by the user to the pixel data range compressing unit 60 according to a user request 64.

As is understood from a comparison of FIG. 5 and FIG. 6, provided that the input pixel data Din are both of 8 bits, the larger the range R of a display apparatus 10 is, the greater the improvement will be in the visibility of the moving images. In the case of FIG. 6, however, the range R is not fully used, with the result that there are instances where the brightness of the whole image is low. In other words, the brightness of the whole image and the visibility of moving images are in a trade-off relationship with each other. Hence, the data write circuit 14, which takes this relationship into consideration, requires the user to specify a desired moving image quality.

Now, since the range R of a display apparatus 10 itself is fixed, the range value that can be taken by input pixel data Din is adjusted. A user request 64 is the result of choice preferring a higher brightness of the whole image or a greater visibility of moving images while suppressing the brightness to a certain degree. According to the user request 64, the moving image quality specifying unit 62 conveys a degree of compression of the range of image data to the pixel data range compressing unit 60. The pixel data range compressing unit 60 compresses the range of pixel data Din outputted from the frame memory 32 linearly or nonlinearly and outputs the result to the output value determining unit 40. The operation of the output value determining unit 40 and thereafter is the same as that in FIG. 2.

Figure 12A:
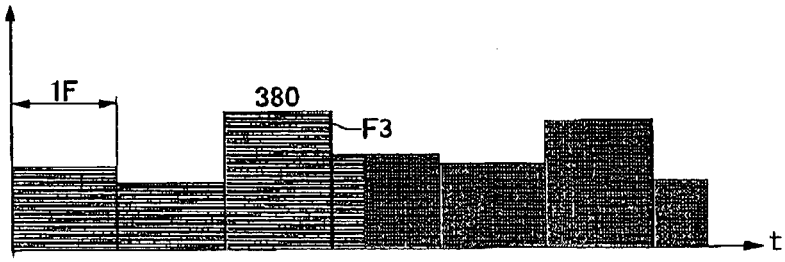
FIGS. 12A to 12C show changes in display brightness with time resulting from an operation of a display apparatus equipped with the data write circuit shown in FIG. 11.
Figure 12B:
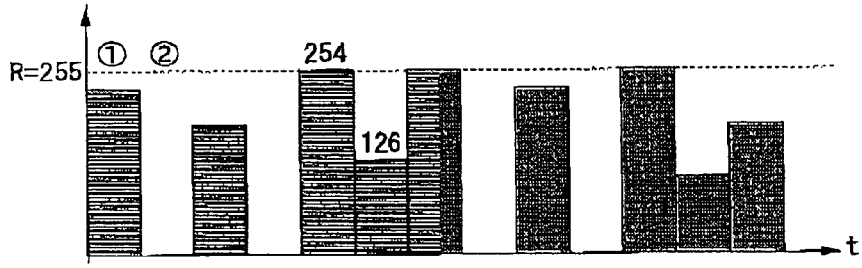
Figure 12C:
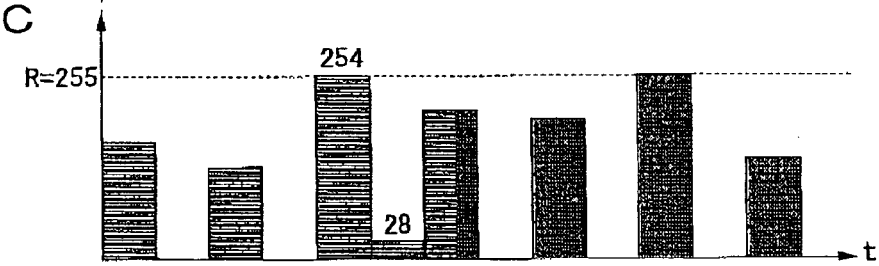

FIGS. 12A to 12C show changes in display brightness with time resulting from the operation of the pixel data range compressing unit 60. FIGS. 12A and 12B are the same as FIGS. 5A and 5B. Here, it is assumed, however, that "380" pixel data are written in frame F3. FIG. 12B shows a case where the user has selected an ordinary brightness. In FIG. 12B, "254" pixel data are written in the first period and the remaining pixel data, that is, 380−254=126 are written in the second period.

On the other hand, FIG. 12C shows a case where the user has instructed that the range of pixel data Din be compressed to improve the visibility of moving images. Here, 256, which is the original range of pixel data Din, is compressed to 190, for instance, and "380", which is the value of pixel data Din is linearly compressed to "282". As a result, "254" pixel data are written in the first period and the remaining pixel data, that is, 282−254=28 are written in the second period. This operation improves the visibility of the moving images.

Figure 13:
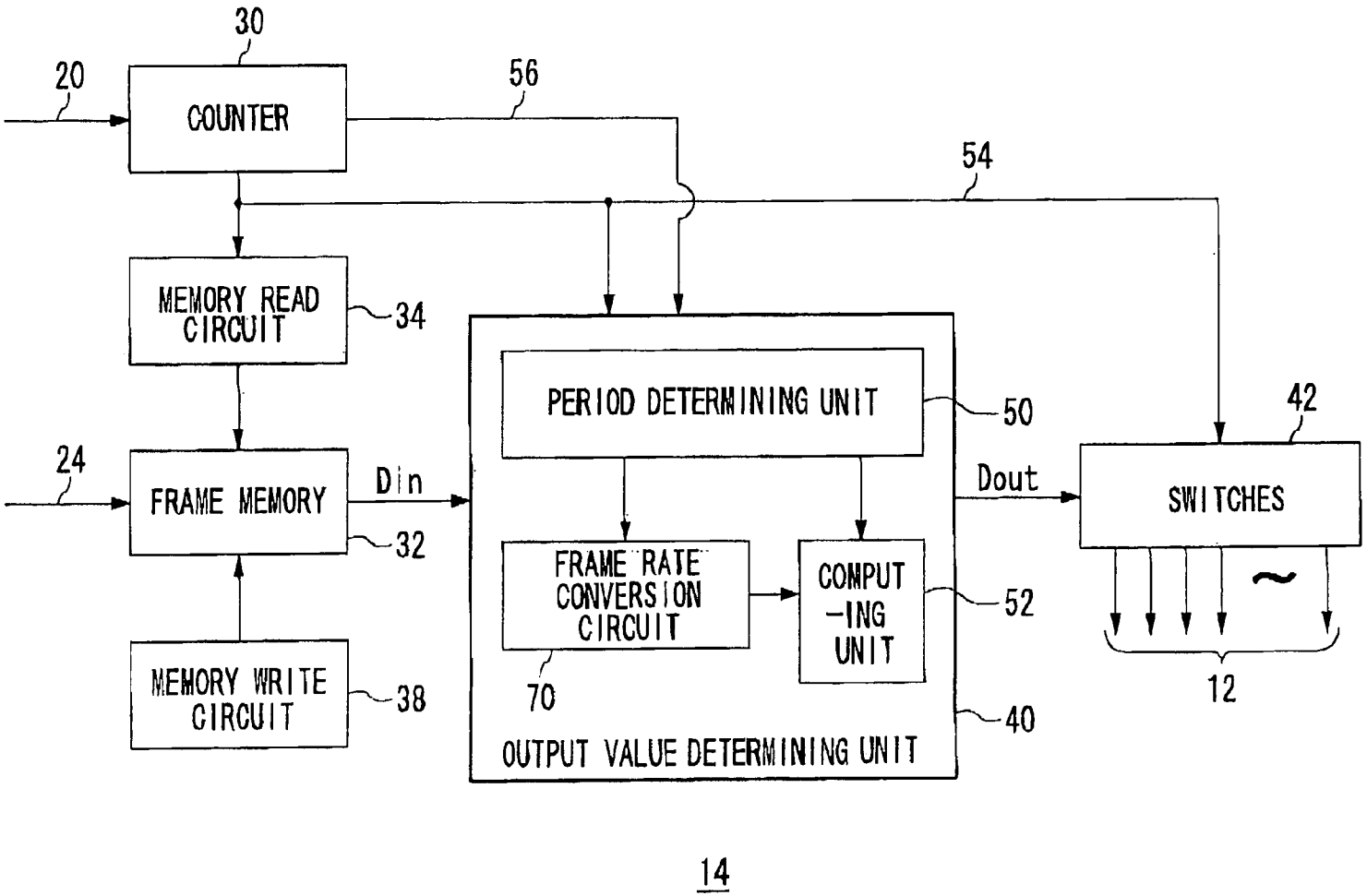
FIG. 13 shows a structure of a data write circuit according to still another embodiment of the present invention.

FIG. 13 shows a structure of a data write circuit 14 according to still, another embodiment of the present invention. In FIG. 13, the components thereof identical to those in FIG. 2 will be designated by the same reference numerals, and the description thereof is omitted as appropriate. A new structure in FIG. 13 is a frame rate conversion circuit 70 in the output value determining unit 40. The function of the computing unit 52 differs. In the description below, it is assumed that pixel data are written at a double speed in the first and second periods.

In this embodiment, the output value determining unit 40 does not simply divide the pixel data of an inputted frame into two periods but generates and outputs the frame data to be generated in the second period through interpolation based on motion compensation. At the output, the data are converted into pixel data for the second period in order to incorporate the improvements in the visibility of moving images as have been described above.

The frame rate conversion circuit 70 calculates motion vectors in units of block, for instance, by performing block matching between two consecutive input frames, and generates an intermediate frame by interpolating the corresponding pixels according to the motion vectors. An intermediate frame is thus created between two consecutive input frames and the computing unit 52 determines pixel data to be written in the second period based on this intermediate frame, so that a smooth display of movements can be realized.

Figure 14A:
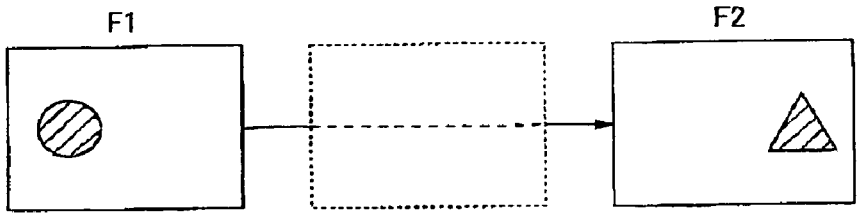
FIGS. 14A to 14E illustrate processings carried out by the data write circuit shown FIG. 13.
Figure 14B:
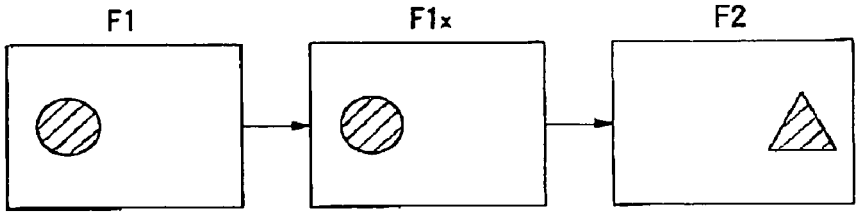
Figure 14C:
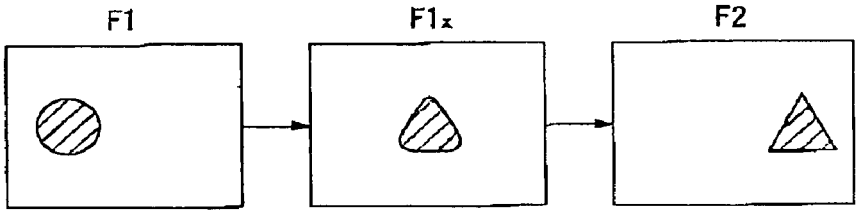
Figure 14D:
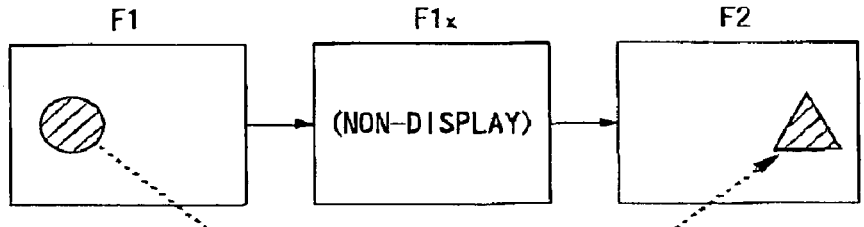
Figure 14E:
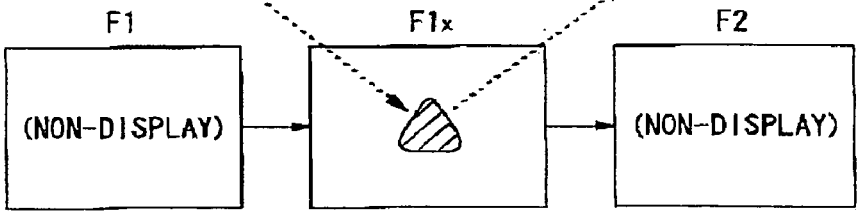

FIGS. 14A to 14E illustrate the cooperation between the frame rate conversion circuit 70 and the computing unit 52 according to this embodiment. FIG. 14A shows 60 Hz input frames F1 and F2 which are to be processed. FIG. 14B shows 120 Hz double-speed frames F1, F1*x* and F2 which are obtained simply by displaying the input frame twice. FIG. 14C shows 120 Hz double-speed frames F1, F1*x* and F2 which are obtained by calculating an interpolation based on a motion compensation for the input frame and interposing the intermediate frame F1*x*. FIG. 14D shows frames F1 ands F2, which are in synchronism with the input frame, of the frames to be outputted finally. FIG. 14E shows the frame, which corresponds to the intermediate frame F1*x* generated through frame conversion, of the frames to be outputted finally. As shown by the broken lines in FIGS. 14D and 14E, the final output is in the order of frame F1 of FIG. 14D, frame F1*x* of FIG. 14E and frame F2 of FIG. 14D.

As shown in FIG. 14A, consecutive frames F1 and F2 are inputted to the frame memory 32, and they are inputted to the frame rate conversion circuit 70 in the output value determining unit 40. Though FIG. 14B shows a case where inputted frames are each displayed twice, this processing is not performed by the data write circuit 14 and is shown only for comparison. That is, when displayed simply twice, a smooth display cannot be achieved because the intermediate frame F1*x* is the same as the first frame F1.

FIG. 14C shows three frames side by side when the intermediate frame F1*x* has been obtained through interpolation by the frame rate conversion circuit 70 from the inputted frames F1 and F2. These three frames are inputted to the computing unit 52. At the point when a frame is outputted from the frame rate conversion circuit 70, the intermediate frame is simply generated from the two frames without any consideration for the visibility of moving images as have been discussed with the above embodiments.

The visibility is improved by the subsequent processing conducted by the computing unit 52. That is, the computing unit 52 generates frames in two systems of FIGS. 14D and 14E from the three frames in the state as shown in FIG. 14C. The frames F1 and F2 in the first system, or FIG. 14D, are both the frames to be displayed in the first period of the frame display period.

Assume, for example, that the range R is 400 and there is a pixel for which the pixel data in the first frame F1 were "300" (hereinafter referred to as "marked pixel"). In this case, the computing unit 52 outputs pixel data, for the frame in question, as a marked pixel in the first frame F1 to be outputted, in a manner as described above. Now, two times the pixel data "300" is in excess of range R=400, and therefore the computing unit 52 outputs "400", as pixel data in the first period for the pixel. At this time, the remaining pixel data are 600−400=200, but, according to this embodiment, the "200" is not used in the second period and is simply discarded.

In place of the discarded "200", the computing unit 52 calculates pixel data for the second period as described below. The computing unit 52 first obtains an intermediate frame F1*x* as shown in FIG. 14C from the frame rate conversion circuit 70. Then it specifies pixel data for the marked pixel in the intermediate frame F1*x*. Now, suppose that the pixel data are "250". Suppose again that the pixel data are divided into the first and the second period in a manner of the above-described embodiments, then the pixel data in the first period will be "400", which is equal to range R, and that in the second period will be "100" because 250×2−400=100. In this embodiment, the pixel data "400" in the first period are discarded, and the pixel data "100" in the second period are outputted as the pixel data for the marked pixel in the second period. And this processing is performed for all the pixels to obtain an intermediate frame F1*x* as shown in FIG. 14E. Therefore, the operation of the computing unit 52 can be summarized as follows:

1) For the frames outputted with timings corresponding to the original input frames F1 and F2, pixel data for the first period calculated for the respective pixels of the input frames are outputted as pixel data for the respective pixels.

2) For an intermediate frame to be generated anew, pixel data for the second period calculated for the respective pixels of the intermediate frame are outputted as pixel data for the respective pixels.

Through the above processings, the frame rate conversion circuit 70 first ensures motion compensation to be reflected in smoothening the motion of the moving images and then the computing unit 52 improves the visibility of the moving images. Therefore, the overall effect is the display of significantly smooth and easy-to-see images.

As for this embodiment, there may be the choice for the computing unit 52 to use an intermediate frame according to the reliability of the intermediate frame generated through motion compensation or not to use it and instead to effect a display by reverting to the methods that have been described with the other embodiments. The processing in the latter case is no different from the calculating and outputting of pixel data for the first, the second and the first period for the three frames as shown in FIG. 14B.

For example when the frame rate conversion circuit 70 detects motion vectors by block matching, the reliability of an intermediate frame can be judged by seeing whether the total sum or square sum of the absolute values of differences in pixel data for the respective pixels between the blocks that show the best matching between the two frames exceeds a predetermined threshold value or not. In other words, when the total sum or the like of the absolute values of differences lie within the threshold value, the two blocks are considered to be in correspondence with each other at a sufficiently high accuracy, thus showing a high reliability. Conversely, when the total sum or the like of the absolute values of differences exceeds the threshold value, the two blocks are considered to be in poor correspondence with each other, thus showing a low reliability. A judging function like this may be incorporated into the frame rate conversion circuit 70, and in response to the notification of "high reliability", the computing unit 52 may carry out a processing using the intermediate frame as in this embodiment. On the other hand, in response to the notification of "low reliability", the computing unit 52 performs a processing without using the intermediate frame. Consequently, when an intermediate frame is considered to have a sufficiently high image quality, it may be used to produce a display with smooth moving images, or otherwise a switch to a safer method may be made to produce the display.

The present invention has been described based on the embodiments which are only exemplary. It is understood by those skilled in the art that there exist other various modifications to the combination of each component and process described above and that such modifications are encompassed by the scope of the present invention. For example, in the above-described embodiment, block matching is used for motion compensation, but it can be achieved by pixel matching, optical flow or other techniques. Moreover, the reliability may be judged based on a more moderate condition, such as whether there has been a scene change or not. That is, when it is determined that there has been a scene change, the reliability can be judged "low". Such a scene change may be detected by using any of the known techniques.

Although the present invention has been described by way of exemplary embodiments, it should be understood that many changes and substitutions may further be made by those skilled in the art without departing from the scope of the present invention which is defined by the appended claims.

What is claimed is:

1. A data write circuit, for driving a hold-type display apparatus, which includes means for writing in a first period n times a desired pixel value to be written to a pixel and writing zero in a second period and thereafter where a frame period corresponding to a frame is divided into n parts and each divided period is denoted by first to nth period; n being an integer greater than or equal to 2.

2. A data write circuit according to claim 1, wherein, when a pixel value that is n times the desired pixel value exceeds a displayable range of the display apparatus, said writing means writes to the pixel an upper limit value of the range in the first period, and an excess part that remains unwritten is written to the pixel upon arrival of the second period and, thereafter, an excess part that cannot be written out in an ith period ($2 \leqq i \leqq n-1$) is written sequentially upon arrival of an (i+1)th period.

3. A data write circuit according to claim 1, including:

a counter which counts write clocks of n times a normal speed;

a memory control unit which reads out a pixel value from a frame memory based on an output from said counter;

an output value determining unit which determines whether the current period is one of first to nth periods, based on an output from said counter and which outputs a write value corresponding to the thus determined period; and a plurality of switches which transmit the write values outputted from said output value determining unit to pixels corresponding thereto.

4. A data write circuit according to claim 3, further including a range compressing unit which compresses a range of the pixel, prior to determination by said output value determining unit.

5. A data write circuit according to claim 1, further including means for calculating a pixel value to be written to the pixel, at the time the pixel value is written in the first to nth periods, in a manner such that the pixel value is calculated after the frame is reconstructed by incorporating a motion compensation that corresponds to time shifts for the divided periods.

6. A data write circuit according to claim 5, further including means for judging, based on the reliability of the reconstructed frame, whether calculation of a pixel value utilizing the reconstructed frame is to be performed or not.

7. A data write circuit, for driving a hold-type display apparatus, which includes means for writing in an ith period ($2 \leqq i < n$) n times a desired pixel value to be written to a pixel and writing zero in periods other than the ith period where a frame period corresponding to a frame is divided into n parts and each divided period is denoted by first to nth period; n being an integer greater than or equal to 2.

8. A data write circuit according to claim 7, wherein, when a pixel value that is n times the desired pixel value exceeds a displayable range of the display apparatus, said writing means writes, in the ith period, an upper limit value of the range to the pixel and distributes an excess part that cannot be written out in a symmetrical manner with the ith period at a center, so that pixel values thus distributed before and after the ith period are written to the pixel.

9. A data write circuit according to claim 7, including:

a counter which counts write clocks of n times a normal speed;

a memory control unit which reads out a pixel value from a frame memory based on an output from said counter;

an output value determining unit which determines whether the current period is one of first to nth periods, based on an output from said counter and which outputs a write value corresponding to the thus determined period; and a plurality of switches which transmit the write values outputted from said output value determining unit to pixels corresponding thereto.

10. A data write circuit according to claim 9, further including a range compressing unit which compresses a range of the pixel, prior to determination by said output value determining unit.

11. A data write circuit according to claim 7, further including means for calculating a pixel value to be written to the pixel, at the time the pixel value is written in the first to nth periods, in a manner such that the pixel value is calculated after the frame is reconstructed by incorporating a motion compensation that corresponds to time shifts for the divided periods.

12. A data write circuit according to claim 11, further including means for judging, based on the reliability of the reconstructed frame, whether calculation of a pixel value utilizing the reconstructed frame is to be performed or not.

13. A hold-type display apparatus, including:

a pixel array;

a data write circuit, for writing data to said pixel array in a row direction, which includes means for writing in a first period n times a desired pixel value to be written to a pixel and writing 0 (zero) in a second period and thereafter where a frame period is divided into n parts and each divided period is denoted by first to nth period (n being an integer greater than or equal to 2); and a scanning line drive circuit which scans said pixel array in a column direction.

14. A hold-type display apparatus, including:

a pixel array;

a data write circuit, for writing data to said pixel array in a row direction, which includes means for writing in an ith period ($2 \leqq i < n$) n times a desired pixel value to be written to a pixel and writing zero in periods other than the ith period where a frame period is divided into n parts and each divided period is denoted by first to nth period; n being an integer greater than or equal to 2; and a scanning line drive circuit which scans said pixel array in a column direction.

* * * * *